United States Patent [19]

Okayasu et al.

[11] Patent Number: 4,681,591

[45] Date of Patent: Jul. 21, 1987

[54] PROCESS FOR PRODUCING AN ELECTROMAGNETIC RADIATION-SHIELDING, METALLIZED POLYESTER FIBER TEXTILE MATERIAL

[75] Inventors: Shinpei Okayasu, Ishikawa; Shinichi Uchikoshi, Kaga; Atsuo Nobatake, Kanazawa, all of Japan

[73] Assignee: Takase Dyeing & Printing Works, Ltd., Osaka, Japan

[21] Appl. No.: 868,163

[22] Filed: May 22, 1986

Related U.S. Application Data

[63] Continuation of Ser. No. 686,252, Dec. 26, 1984, abandoned.

[30] Foreign Application Priority Data

Aug. 20, 1984 [JP] Japan ..... 59-171420

[51] Int. Cl.[4] ..... D06M 5/02; D06M 11/00

[52] U.S. Cl. ..... 8/115.68; 8/115.69; 8/922; 428/229; 428/263; 428/289

[58] Field of Search ..... 8/115.68, 115.69; 428/263

[56] References Cited

U.S. PATENT DOCUMENTS 4,390,588 6/1983 Ebneth et al. ..... 428/263

4,614,684 9/1986 Ebneth et al. ..... 428/252

*Primary Examiner*—A. Lionel Clingman

*Attorney, Agent, or Firm*—McAulay, Fields, Fisher, Goldstein & Nissen

[57] ABSTRACT

An improved process for producing an electromagnetic radiation-shielding, metallized polyester fiber textile material comprising the steps of: pre-treating a textile material containing at least 15% by weight of polyester fibers with an aqueous solution of a caustic alkali to an extent that the weight of the polyester fibers is decreased from 10% to 35% based on the original weight of the polyester fibers; activation-treating the pre-treated textile material with a tin (II)-containing compound and with a palladium-containing compounds; and nonelectrolytically plating the activation-treated textile material in a plating mixture containing a compound of an electroconductive metal selected from the group consisting of nickel, copper, cobalt, chromium, and alloys of at least two of the above-mentioned metals to form a metal coating thereon.

4 Claims, No Drawings

PROCESS FOR PRODUCING AN ELECTROMAGNETIC RADIATION-SHIELDING, METALLIZED POLYESTER FIBER TEXTILE MATERIAL

This application is a continuation, of application Ser. No. 686,252, filed Dec. 26, 1984 now abandoned.

BACKGROUND OF THE INVENTION

1. Field of the Invention

The present invention relates to an improved process for producing an electromagnetic radiation-shielding, metallized polyester fiber textile material containing polyester fibers. More particularly, the present invention relates to an improved and highly efficient process for metallizing a textile material containing polyester fibers by firmly fixing a metal coating thereto.

The electromagnetic radiation-shielded textile material containing polyester fibers metallized in accordance with the process of the present invention exhibits an excellent electroconductivity and is useful for shielding electronic devices from interference caused by electromagnetic radiation.

2. Description of the Related Art

Various processes are known for producing an electroconductive textile material by non-electrolytically plating a non-conductive textile material to metallize the material.

For example, Japanese Unexamined Patent Publication (Kokai) No. 54-55700 discloses a process for metallizing a textile material with a metal by immersing a textile material containing, for example, polyacrylonitrile fibers, in an acid aqueous colloidal palladium solution containing stannous ions, by activation-treatment of the palladium and tin (II)-impregnated textile material with an acid or alkali aqueous solution, and then by non-electrolytically plating the activation-treated textile material in an alkali solution of a compound of the metal.

Further, Japanese Examined Patent Publication (Kokoku) Nos. 40-27400, 46-22919, 49-43518 and 49-43519 disclose a process for metallizing a textile material with a metal by activation-treatment of a textile material with an aqueous solution of palladium chloride or stannous chloride, or by activation-treatment of the textile material with a stannous chloride aqueous solution and with a palladium chloride aqueous solution, and then, by non-electrolytically plating the activation-treated textile material with the metal.

However, a problem of the known processes is that when these processes are applied to a textile material containing polyester fibers, the resultant metallized textile material exhibits an unsatisfactory electroconductivity and uneven quality.

To eliminate the above-mentioned problem, attempts have been made to apply a pre-etching treatment with an acid or alkali to a textile material containing polyester fibers before the metallizing process.

For example, Japanese Examined Patent Publication (Kokoku) Nos. 46-22919, 49-43518 and 49-43519 disclose a pre-etching treatment of the polyester fiber textile material with an aqueous solution of 80 g/l of sodium hydroxide at a temperature of 50° C. for one hour, or with an aqueous solution of 100 g/l of sodium hydroxide at a temperature of 60° C. for 30 minutes, or with an aqueous solution of 1 g/l of sodium hydroxide and 4 g/l of lauryldimethylbenzyl ammonium chloride at a temperature of 80° C. for 60 minutes.

The above-mentioned pre-etching processes have had a slight effect toward improving the metallizing property of the polyester fiber textile material, but are not very satisfactory.

Furthermore, it is known that the purity of the metal coating provided on the textile material by the conventional non-electrolytical plating process is unsatisfactory and that the crystallinity of the plated metal coating is insufficient, and therefore, the electroconductivity of the metallized textile material is unsatisfactory.

SUMMARY OF THE INVENTION

An object of the present invention is to provide an improved process for metallizing a textile material containing polyester fibers, which process is effective for increasing the amount of the resultant metal coating, and for obtaining a uniform quality of resultant metal coating to produce an electromagnetic radiation-shielded textile material.

Another object of the present invention is to provide an improved process for metallizing a textile material containing polyester fibers, which process is effective for enhancing the bonding strength of the metal coating with the polyester fibers and for increasing the purity of the metal in the metal coating so as to enhance the electroconductivity of the resultant metallized textile material.

The above-mentioned objects can be attained by the process of the present invention for metallizing a textile material containing polyester fibers, which process comprises the steps of: pre-treating a textile material containing at least 15% by weight of polyester fibers with an aqueous solution of a caustic alkali to an extent that the weight of the polyester fibers decreases by at least 10%, based on the original weight of the polyester fibers; activation-treatment of the pre-treated textile material with a tin (II)-containing compound and with a palladium-containing compound; and non-electrolytically plating the activation-treated textile material with an electroconductive metal to form a metal coating thereon. In the process of the present invention, the resultant metallized textile material may be additionally treated with an aqueous solution of at least one member selected from the group consisting of oxalic acid and formic acid, to prevent undesirable rusting of the metal coating.

DESCRIPTION OF THE PREFERRED EMBODIMENT

In the first step of the process of the present invention, a textile material containing polyester fibers is pre-treated with an aqueous solution of a caustic alkali.

The textile material usable for the process of the present invention contains at least 15% by weight, preferably at least 35% by weight, of polyester fibers. The textile material is not limited to a specific composition and/or a specific structure. That is, the textile material can be selected from yarns, woven fabrics, knitted fabrics, nonwoven fabrics, and composite materials consisting of at least two of the above-mentioned materials.

The polyester fibers may be in the form of staple fibers or filaments, and have the structures of blended fiber spun yarns, composite yarns, or woven and knitted fabrics made from blended fiber spun yarns or from a plurality of different types of yarns.

The textile material may contain, in addition to the polyester fibers, any type of different fibers; preferably fibers resistant to pretreatment with the caustic alkali aqueous solution and the non-electrolytical plating process in an acid or alkaline plating liquid. The different type of fibers may be selected from cotton, nylon 6, nylon 66, acrylic fibers, and glass fibers.

The polyester fibers are not restricted to specific types, as long as the fibers can be weight-decreased by the caustic alkali pre-treatment. Usually, the polyester fibers are polyethylene terephthalate fibers.

The pretreating step in the process of the present invention is carried out to an extent that the weight of the polyester fibers in the textile material decreases by at least 10%, preferably 10% to 35%, based on the original weight of the polyester fibers.

When the decrease in the weight of the polyester fibers is less than 10% by weight, the effect of the pretreating step on the amount of the resultant metal coating and on the bonding strength of the resultant metal coating to the polyester fibers becomes unsatisfactory, i.e., the same as that of the conventional pre-etching process.

In the conventional pre-etching process, the surfaces of the fibers are made rough so as to increase the surface area of the fibers, and therefore, to promote the deposition of metal on the surfaces of the fibers. However, the above-mentioned etching process for fiber surface-roughening or cave-forming on the fiber surfaces is not satisfactory in the enhancement of the formation of the metal coating.

However, it was discovered by the inventors of the present invention that the pretreatment of the polyester fiber-containing textile material with the caustic alkali aqueous solution to an extent that the weight of the polyester fibers decreases by 10% by weight, is surprisingly effective for activating the surface of the polyester fibers and for promoting the formation of the plated metal coating.

Usually, it is expected that the decrease in the weight of the polyester fibers by the treatment with caustic alkali aqueous solution causes the decrease in thickness and in the surface area of the polyester fibers, and therefore, results in a decrease in the amount of the plated metal coating on the surface of the polyester fibers. However, in the process of the present invention, the decrease in the weight of the polyester fibers is unexpectedly highly effective not only for increasing the amount of the resultant plated metal coating, but also for enhancing the bonding strength of the metal coating to the polyester fiber surface. The reasons for the increase in the amount of the plated metal coating and in the bonding strength between the metal coating and the polyester fiber surfaces are not completely clear. However, it is assumed that the decrease in the weight of the polyester fibers in the pretreating step in the process of the present invention causes the formation of fresh surfaces of the polyester fibers which are highly active for accelerating the deposition of metal coating on the surfaces and for firmly bonding with the resultant metal coating on the surfaces.

The above-mentioned effects of the pre-treating step in the process of the present invention are not expected from the effects of the conventional pre-etching step.

The aqueous solution of the caustic alkali usable for the pretreating step in the process of the present invention preferably contains from 50 g/l to 200 g/l of sodium hydroxide and/or potassium hydroxide, preferably, sodium hydroxide.

The polyester fiber-containing textile material is immersed in the caustic alkali aqueous solution, preferably at a temperature of from 25° C. to 130° C., for a time period necessary to reach a desired level of the weight decrease of the polyester fibers, for example, for 10 minutes to 20 hours. After the desired level of weight decrease is obtained, the pre-treated textile material is washed with hot water, is neutralized if necessary, and is then dried.

The pre-treating step is not limited to the above-mentioned immersing method. That is, the pre-treating step can be carried out by impregnating the textile material with a caustic alkali aqueous solution, and by then a steam-heating the textile material. Alternatively, the textile material impregnated with the caustic alkali aqueous solution is wound up into a roll and the roll is placed in an atmosphere having a predetermined temperature and humidity, or is left to stand at room temperature for one night, in accordance with the so-called cold-batch method.

In the process of the present invention, the pretreated textile material is activation-treated with a tin (II)-containing compound and with a palladium-containing compound.

The activation-treatment may be effected either in two steps or in a single step.

In the two-step activation treatment, first the pretreated textile material is treated with an aqueous solution of a tin (II)-containing compound, for example, an aqueous solution containing a stannous chloride and acidified with hydrochloric acid. The first-treated textile material is then washed with water followed by a second treatment with an aqueous solution of a palladium-containing compound, for example, an aqueous solution containing palladium chloride and acidified with hydrochloric acid, and the second-treated textile material is then washed with water.

In the first tin (II) treatment, the concentration of stannous chloride is preferably in the range of from 5 g/l to 20 g/l and the concentration of hydrochloric acid is preferably in the range of from 2 ml/l to 20 ml/l of a 35% by weight concentrated hydrochloric acid. The first tin (II) treatment is usually carried out at a temperature of from 25° C. to 35° C. for 3 to 30 minutes.

In the second palladium treatment, the concentration of palladium chloride is preferably in the range of from 0.2 g/l to 0.40 g/l and the concentration of hydrochloric acid is preferably in the range of from 1 ml/l to 3 ml/l of a 35% by weight concentrated hydrochloric acid.

The second palladium, treatment is usually carried out at a temperature of from 25° C. to 40° C. for 3 to 30 minutes.

In the single step activation treatment, for example, in accordance with the method disclosed in Japanese Unexamined Patent Publication (Kokai) No. 54-55700, the pre-treated textile material containing polyester fibers is treated with an acid aqueous colloidal palladium solution containing stannous ions, for example, an aqueous colloidal solution containing palladium chloride and stannous chloride and acidified with hydrochloric acid, preferably at room temperature for a short time period of from 10 seconds to 2 minutes. The treated textile material is washed with water, treated with acid or alkali and, finally, is washed with water. The activation-treated textile material is subjected to a non-electrolytical plating step.

In the non-electrolytical plating step of the present invention, the activation-treated textile material is plated in a plating bath containing a compound, which releases ions of a metal to be plated, for example, a metal salt, an alkali and/or ammonia, a reducing agent and, optionally, a plating auxiliary at a temperature of from 25° C. to 95° C. for a time necessary to form a metal coating in a desired amount.

In the process of the present invention, the metal to be plated is selected from the group consisting of nickel, copper, cobalt, chromium, and alloys of at least two of the above-mentioned metals. The metal compound which releases ions of the metal to be plated is selected from the group consisting of halides, sulfates, nitrates, acetates, and formates of the above-mentioned metals. Chlorides of the above-mentioned metals are preferably used for the process of the present invention.

The alkali, usually sodium hydroxide, and/or ammonia is used for adjusting the pH of the plating liquid to a desired value, usually in the range of from 9 to 13.

The reducing agent preferably consists of at least one member selected from the group consisting of sodium hypophoshite, formaldehyde, boron hydride, and hydrazine. More preferably, the reducing agent consists of hydrazine. When hydrazine is used as a reducing agent, the resultant metal coating has a high purity and an enhance crystallinity of the metal crystals and, therefore, the resultant metallized textile material exhibits an enhanced electroconductivity.

The plating auxiliary may consist of at least one member selected from sodium citrate, potassium sodium tartrate, and sodium tartrate.

Usually, the metallized textile material produced in accordance with the process of the present invention has a metal coating in an amount of 10% to 50% based on the original weight of the textile material. The metallized textile material preferably exhibits a high surface resistivity (sheet resistivity) of 10 ohms or less, more preferably $10^{-2}$ to 10 ohms. The metal coating formed on the polyester fibers in the textile material is not limited to one having a specific thickness, and preferably, has a thickness of from 0.01 to 0.5 microns.

The metal coating produced in accordance with the process of the present invention is firmly fixed to the polyester fibers and, therefore, the metallized textile fabric exhibits an excellent fastness for laundering.

In the process of the present invention, the metallized textile material is optionally after-treated with a treating liquid which neither reacts with nor dissolves therein the metal coating, but can remove the oxides of the metal, thus preventing the production of rust (oxides) on the metal coating. The rust prevention-treatment liquid preferably contains at least one member selected from formic acid and oxalic acid.

The concentration of the above-mentioned acids in the treating liquid is preferably in the range of from 1 g/l to 5 g/l. The rust-prevention treatment is carried out preferably at room temperature or in the range of from 25° C. to 60° C.

After the rust-prevention treatment is completed, the metallized textile material is thoroughly washed with water and, finally, is dried.

In the process of the present invention, the amount of the metal coating produced on the textile material can be increased by the combination of the step of the pretreatment of the textile material containing polyester fibers with an aqueous caustic alkali solution, to cause the weight of the polyester fibers to decrease by 10% based on the original weight of the polyester fibers, with the step of the activation-treatment of the pretreated textile material and the step of the non-electrolytical plating of the activation-treated textile material.

Also, by using the two-step activation treating method and/or by using hydrazine as a reducing agent in the non-electrolytical plating step, it becomes possible to enhance the bonding strength of the metal coating with the textile material, to increase the purity of the metal in the metal coating, and therefore, to enhance the electroconductivity of the resultant metallized textile material.

SPECIFIC EXAMPLES OF THE INVENTION

The specific examples presented below will to serve more fully elaborate the practice of the present invention. However, it should be understood that the examples are only illustrative and in no way limit the present invention.

EXAMPLE 1

A plain weave polyester fiber spun yarn fabric consisting of polyethylene terephthalate staple fibers having a denier of 2 and a length of 60 mm, and having a weight of 120 g/m$^2$ and the following weave structure:

$$\frac{30^s \times 30^s}{68 \text{ yarns}/2.54 \text{ cm} \times 60 \text{ yarns}/2.54 \text{ cm}}$$

was used as the base material to be metallized.

The fabric was subjected to the following treatments in succession:

(A) Scouring and Bleaching

The polyester fiber fabric was impregnated with a scouring liquid of the following composition;

| | |
|---|---|
| Caustic soda | 5% by weight |
| sodium persulfate | 0.2% by weight |

The impregnated fabric was squeezed, heated with steam at a temperature of 100° C. for 60 minutes, and then washed with water.

The scouring treatment resulted in a decrease of 5% in the weight of the polyester fiber fabric.

The scoured polyester fiber fabric was bleached with a bleaching liquid having the following composition:

| | |
|---|---|
| Sodium chlorite | 0.3% by weight |
| Polyphosphoric acid | 0.5% by weight |

The bleaching procedure was carried out at a pH of 4.5. the bleached polyester fiber fabric was washed with water and, finally, dried.

(B) Weight-decreasing treatment

The scoured, bleached polyester fiber fabric was treated by using a liquid-circulating type treating machine at a temperature of 98° C. for 2 hours with a treating liquid containing 6% by weight of caustic soda at a liquor ratio of 1:8.

The above-mentioned treatment resulted in a weight decrease of 20% based on the original weight of the polyester fiber fabric.

The sum of the decreased weight in the scouring and weight decreasing treatments was 5+20=25%.

(C) Activation-treatment (Two step method)

(i) Stannous compound treatment

The weight decreased polyester fiber fabric was immersed in a treating aqueous solution which was prepared by dissolving 16 g/l of stannous chloride in an of aqueous solution of 20 ml/l of hydrochloric acid at room temperature for 3 minutes, to allow the fabric to absorb the stannous compound, and was immediately washed with water the remove the non-absorbed stannous compound.

(ii) Palladium compound treatment

The stannous compound-treated polyester fiber fabric was immersed in a treating aqueous solution containing 0.3 g/l of palladium chloride and 3 ml/l of hydrochloric acid, at room temperature for 15 minutes, to allow the fabric to absorb the palladium compound, and was immediately washed with water to thoroughly remove the non-absorbed palladium compound.

(D) Non-electrolytical plating treatment

The activation-treated polyester fiber fabric was non-electrolytically plated with nickel in a plating liquid which contained 27.5 g/l of nickel chloride, 60 g/l of sodium citrate, and 60 ml/l of hydrazine and was adjusted to a pH of 12.8 by a 28% caustic soda aqueous solution, at a temperature of 85° C. for 20 minutes, and then washed with water.

In the resultant metallized fabric, the content of the nickel coating was about 20% and the thickness of the metal coating was approximately 0.3 microns.

(E) Rust-prevention aftertreatment

The metallized polyester fiber fabric was treated with 0.1% oxalic acid aqueous solution at a temperature of from 60° C. to 7° C. for 10 minutes and then dried.

The resultant metallized polyester fiber fabric exhibited a surface resistivity (sheet resistivity) of 1.95 ohms.

The resultant metallized polyester fiber fabric was subjected to a laundering test in accordance with the Japanese Industrial Standard (JIS) L-0844, A-2 method, for 30 minutes. After the laundering test, the laundered fabric exhibited a low surface resistivity of 4.23 ohms, that is, still maintained an excellent electroconductivity.

EXAMPLES 2, 3 AND 4 AND COMPARATIVE EXAMPLE 1

In each of Examples 2 to 4 and Comparative Example 1, the same procedures as those described in Example 1 were carried out except that in Examples 2 to 4, the weight-decreasing treatment was carried out to an extent such that the resultant weight decrease was as indicated in Table 1. In Comparative Example 1, no weight-decreasing treatment was carried out.

Table 1 also shows the amounts of the resultant metal coatings in Examples 1 to 4 and Comparative Example 1.

TABLE 1

| Item | Example | | | | |
|---|---|---|---|---|---|
| | Comparative Example 1 | Example 2 | 1 | 3 | 4 |
| Weight decrease (%) | 5 | 10 | 25 | 35 | 55 |

TABLE 1-continued

| Item | Example | | | | |
|---|---|---|---|---|---|
| | Comparative Example 1 | Example 2 | 1 | 3 | 4 |
| Amount of metal coating (%) | 18.7 | 20.3 | 24.1 | 25.6 | 32.7 |

Table 1 shows that when the weight decrease of the polyester fiber fabric by the alkali treatment is about 5% or less, which is similar to the results in the conventional etching treatments, the amount of the resultant metal coating is unsatisfactory.

EXAMPLES 5 AND 6

In each of Examples 5 and 6, the same procedures as those disclosed in Example 1 were carried out with the following exception.

The sum of the weight decreases of the polyester fiber fabric in the scouring and weight-decreasing steps was 30%. Also, in Example 6, the activation-treatment was carried out in a single step method by using a treating colloidal liquid having the following composition:

| | |
|---|---|
| Stannous chloride | 25 g/l |
| Palladium chloride | 0.3 g/l |

35 weight % hydrochloric acid 10 ml/l In the activation-treatment in Example 6, the polyester fiber fabric was immersed in the treating colloidal liquid at a pH of 1 at room temperature for 3 minutes, was washed with water, and finally, was treated with a 10% sulfuric acid aqueous solution at a temperature of 40° C.

The amounts of the resultant metal coatings were 28.3% in Example 5 and 26.5% in Example 6. The results of Examples 5 and 6 indicated that the two-step activation treatment is more advantageous in the amount of the metal coating than the single step activation treatment.

The metallized fabrics of Examples 5 and 6 were subjected to a test for fastness for laundering in accordance with the JIS L-0844, A-2 method. The surface resistivities (sheet resistivities) of each fabric before and after the laundering test were determined, and the results are shown in Table 2.

TABLE 2

| Example No. | Activation treatment | (Surface resistivity, Ohm) Item: Laundering time (minute) 0 | 10 | 30 | 60 |
|---|---|---|---|---|---|
| 5 | Two step method | 1.85 | 2.65 | 7.06 | 8.45 |
| 6 | Single step method | 6.9 | 47.5 | 80.0 | >110.0 |

Table 2 also shows that the two step activation treatment is more advantageous in the fastness of the resultant metal coating for laundering than the single step activation treatment.

EXAMPLES 7 AND 8

In Examples 7 and 8, the same procedures were carried out as those described in Examples 5 and 6, respectively, except that in the non-electrolytical plating step, 10 g/l of sodium hypophosphate was used as a reducing agent in place of hydrazine.

The amounts of the metal coatings in the resultant metallized fabrics were 25.0% in Example 7 and 19.6% in Example 8. These results show that the two step activation treatment (Example 7) is more advantageous in the amount of the metal coating than the single step activation treatment (Example 8). From the comparison of the amounts of the metal coatings in Examples 7 and 8 with those in Examples 5 and 6, it is clear that hydrazine is more effective for increasing the amount of the metal coating than sodium hypophosphate.

EXAMPLES 9 AND 10

In each of Examples 9 and 10, the same procedures as those described in Example 5 were carried out except that the amount of the resultant metal coating was adjusted to 30% and in Example 10, 10 g/l of sodium hypophosphate was used in place of hydrazine as a reducing agent for the non-electrolytical plating step.

The resultant metallized polyester fiber fabrics were subjected to the laundering test in accordance with the JIS L-0844, A-2 method and the surface (sheet) resistivities of the fabrics before and after the laundering test were determined. The results are shown in Table 3.

TABLE 3

(Surface resistivity, Ohm)

| Example No. | Reducing agent | Laundering time (minute) 0 | 10 | 30 | 60 |
|---|---|---|---|---|---|
| 9 | Hydrazine | 1.0 | 5.55 | 11.0 | 17.0 |
| 10 | Sodium hypophosphate | 8.7 | >110 | >110 | >110 |

Table 3 clearly shows that hydrazine as a reducing agent is more advantageous in the electro-conductivity and fastness for laundering of the resultant metal coating than sodium hypophosphate. It is assumed that hydrazine is highly effective for enhancing the bonding strength of the metal coating to the polyester fibers, for increasing the purity of the metal coating, and for enhancing the crystallinity of the metal crystals in the metal coating.

EXAMPLE 11

The same procedures as those described in Example 1 were carried out except that the non-electrolytical plating liquid had the following composition:

| | |
|---|---|
| Cobalt chloride | 15 g/l |
| Hydrazine | 50 g/l |
| Sodium tartrate | 80 g/l |

The plating procedure was carried out at a pH of 12.8 and at a temperature of 85° C. for 20 minutes.

The amount of the metal coating in the resultant metallized polyester fiber fabric was 15% and the surface resistivity of the fabric was 22 ohms.

EXAMPLE 12

The same procedures as those described in Example 1 were carried out except that the non-electrolytical plating liquid had the following composition.

| | |
|---|---|
| Nickel chloride | 5 g/l |
| Cobalt chloride | 10 g/l |
| Hydrazine | 60 g/l |
| Sodium tartrate | 92 g/l |

The plating procedure was carried out at a pH of 12.8 and at a temperature of 85° C. for 20 minutes.

The amount of the resultant metal coating consisting of a nickel-cobalt alloy on the metallized polyester fiber fabric was 11.8% and the surface (sheet) resistivity of the fabric was 10 ohms.

We claim:

1. A process for metallizing a textile material having a high surface or sheet resistivity of $10^{-2}$ to 10 ohms and containing polyester fibers to produce a material to shield electronic devices from electromagnetic radiation interference, comprising the steps of:

pre-treating a textile material containing at least 15% by weight of polyester fibers with an aqueous solution of a caustic alkali to an extent that the weight of the polyester fibers is decreased by at least 10% based on the original weight of the polyester fibers for activating the surface of the polyester fibers to increase the amount of a metal coating which can be plated onto the polyester fibers for enhancing the bonding strength of the polyester fiber surfaces to the metal coating;

activation-treating the pre-treated textile material with a tin (II)-containing compound and with a palladium-containing compound;

non-electrolytically plating the activation-treated textile material in a plating liquid containing a compound of an electroconductive metal to be plated, an alkali and/or ammonia, and hydrazine as a reducing agent to form a plated metal coating thereon, said hydrazine being used as a reducing agent in the non-electrolytical plating liquid, the resultant metal coating having a high purity and an enhanced crystallinity of the metal crystals such that the resultant metallized textile material exhibits an enhanced electroconductivity; and said electroconductive metal being selected from the group consisting of nickel, cobalt, chromium, and alloys of at least two of the above-mentioned metals, said pretreating step being effective for activating the surface of the polyester fibers for promoting the formation of the plated metal coating.

2. The process as claimed in claim 1, wherein the metal compound to be treated releases ions of the metal to be plated is selected from the group consisting of halides, sulfates, nitrates, acetates and formates.

3. The process as claimed in claim 1, wherein the plating auxiliary consists of at least one member selected from the group consisting of sodium citrate, potassium sodium tartrate and sodium tartrate.

4. The process as claimed in claim 1, wherein said electroconductive metal is selected from the group consisting of nickel and cobalt and alloys solely of both of the aforementioned metals.

* * * * *